US007178929B2

(12) United States Patent
Guzman

(10) Patent No.: US 7,178,929 B2
(45) Date of Patent: Feb. 20, 2007

(54) LIGHT AND SOUND PRODUCING SYSTEM

(75) Inventor: Rudy Guzman, Coral Springs, FL (US)

(73) Assignee: BBC International, Ltd., Boca Raton, FL (US)

( * ) Notice: Subject to any disclaimer, the term of this patent is extended or adjusted under 35 U.S.C. 154(b) by 85 days.

(21) Appl. No.: 10/988,321

(22) Filed: Nov. 12, 2004

(65) Prior Publication Data

US 2006/0104047 A1 May 18, 2006

(51) Int. Cl.
*F21V 21/08* (2006.01)

(52) U.S. Cl. ..... 362/103; 362/86

(58) Field of Classification Search ..... 362/86, 362/103, 276, 802
See application file for complete search history.

(56) References Cited

U.S. PATENT DOCUMENTS

| | | | | |
|---|---|---|---|---|
| 3,855,784 | A * | 12/1974 | Foellner | 368/67 |
| 4,350,853 | A | 9/1982 | Ganyard | 200/52 R |
| 4,517,424 | A | 5/1985 | Kroczynski | 200/52 R |
| 4,646,350 | A | 2/1987 | Batra | 381/51 |
| 5,159,768 | A | 11/1992 | Longo, Jr. | 36/139 |
| 5,343,190 | A | 8/1994 | Rodgers | 340/573 |
| 5,345,700 | A | 9/1994 | Norment | 36/139 |
| 5,422,628 | A | 6/1995 | Rodgers | 340/573 |
| 5,558,429 | A * | 9/1996 | Cain | 362/155 |
| 5,649,376 | A | 7/1997 | Lecates, Jr. | 36/137 |
| 5,714,706 | A | 2/1998 | Nakada et al. | 84/730 |
| 5,720,200 | A * | 2/1998 | Anderson et al. | 73/172 |
| 5,748,087 | A | 5/1998 | Ingargiola et al. | 340/573 |
| 5,765,300 | A | 6/1998 | Kianka | 36/139 |
| 5,812,063 | A | 9/1998 | Weng et al. | 340/815.45 |
| 5,813,148 | A | 9/1998 | Guerra | 36/137 |
| 5,855,080 | A | 1/1999 | Van Staden | 36/139 |
| 5,894,201 | A | 4/1999 | Wong | 315/241 S |
| 5,894,686 | A | 4/1999 | Parker et al. | 36/137 |
| 5,909,088 | A | 6/1999 | Wut | 315/200 A |
| 5,969,479 | A | 10/1999 | Wong | 315/200 A |
| 6,000,149 | A | 12/1999 | Pomerantz | 36/139 |
| 6,012,822 | A | 1/2000 | Robinson | 362/103 |
| 6,030,089 | A | 2/2000 | Parker et al. | 362/103 |
| 6,225,885 | B1 | 5/2001 | Lin | 335/206 |
| RE37,220 | E | 6/2001 | Rapisarda et al. | 362/189 |
| 6,265,984 | B1 * | 7/2001 | Molinaroli | 340/815.4 |
| 6,278,378 | B1 | 8/2001 | Feiner et al. | 340/815.45 |
| 6,286,975 | B1 | 9/2001 | Rodgers | 362/103 |
| 6,525,487 | B2 | 2/2003 | Wei | 315/200 A |
| 6,554,679 | B1 | 4/2003 | Schackelford et al. | 446/268 |
| 2005/0174243 | A1 * | 8/2005 | Musil | 340/574 |

FOREIGN PATENT DOCUMENTS

| | | | |
|---|---|---|---|
| EP | 0917893 | * | 5/1997 |
| EP | 1 552 761 A1 | | 7/2005 |
| GB | 2282521 A | * | 10/1993 |
| GB | 2 352 551 A | | 1/2001 |

* cited by examiner

*Primary Examiner*—Renee Luebke
*Assistant Examiner*—Julie A. Shallenberger
(74) *Attorney, Agent, or Firm*—GrayRobinson, P.A.

(57) ABSTRACT

A system for producing sound and light includes a shoe or other article of footwear having multiple sources of light and at least one loudspeaker, and a unit located remotely from the shoe which is operative to transmit an RF signal to a receiver within the shoe causing the loudspeaker to sound.

9 Claims, 5 Drawing Sheets

LIGHT AND SOUND PRODUCING SYSTEM

FIELD OF THE INVENTION

This invention relates to a system for producing light and sound, and, more particularly, to the combination of an article of clothing or other item worn by a user and a shoe which mounts an array of light sources such as LEDs and a loudspeaker. The article of clothing has a circuit which is operative to transmit an RF signal to a circuit in the shoe causing the loudspeaker to sound, while the array of light sources in the shoe are illuminated independently by operation of an inertia switch.

BACKGROUND OF THE INVENTION

For a number of years, articles of footwear and various items of clothing have been sold with decorative arrays of light sources such as light emitting diodes (LEDs) and/or a loudspeaker capable of producing a sound. This has been particularly popular in children's shoes where the LEDs are arranged to complement other design elements of the shoe such as cartoon characters and the like.

In a typical design of a children's shoe of the type noted above, a module including a plastic housing is placed in a cavity usually formed in the heel area of the shoe. The module mounts a battery, a switch and conventionally an integrated circuit which is connected by wires to LEDs positioned along the outsole, upper or tongue of the shoe. The integrated circuit may also be capable of generating a signal operative to sound a loudspeaker, typically mounted in the upper or tongue of the shoe in the general area of the LEDs. Systems of this type are shown, for example, in U.S. Pat. Nos. 6,525,487; 6,286,975; 6,012,822; 5,969,479; 5,894,201; 5,812,063 and others.

The integrated circuits employed in modules for children's shoes and other applications are conventionally activated by one or more switches carried on or otherwise coupled to the module. In some designs, the switch turns on and off in response to the application of an inertial force, pressure or motion. Spring switches such as disclosed in U.S. Pat. Nos. RE37,220 and 5,909,088 are a popular choice for children's shoes because they are reliable, noiseless and movable from a neutral or off position to a closed or on position in response to walking, running or other motion of the shoe. Pressure switches such as shown in U.S. Pat. Nos. 5,159,768; 5,649,376; 5,855,080 and 5,714,706 are also employed and they operate in response to the application of a weight, e.g. when the child steps onto a surface.

Another type of switch employed in children's shoes and similar applications is a manually activated switch such as shown in U.S. Pat. Nos. 5,894,686; 6,278,378 and 5,813,148. Manual switches are employed to turn on and off the light source carried by the shoe, to select different modes of operation for the integrated circuit associated with the shoe, e.g. different flashing sequences or other operations, and for other purposes. Some systems, such as disclosed in the U.S. Pat. No. 5,813,148, employ both manual and inertial switches to activate light sources and/or sound sources associated with the shoe. In the '148 system, the manual switch turns on and off a light source, and also causes a controller including an integrated circuit to activate a particular mode of operation. One of the modes of operation enables an inertia or pressure sensitive switch, which then operates to activate the light source in a selected flashing sequence.

All of these arrangements involve either the "automatic" activation of the light sources and/or loudspeaker(s) in the sense that an inertia, pressure or motion switch operates without manual intervention, or, alternatively, manual switches associated with the shoe are operated to activate the light sources and loudspeakers. In either case, a switch or switches carried by the shoe cause the light sources or loudspeaker to operate.

SUMMARY OF THE INVENTION

This invention is directed to a system which includes an article of footwear having one or more light sources such as LEDs, and a loudspeaker. The loudspeaker is activated in response to the transmission of an RF signal from an article of clothing or other item worn or manipulated by the wearer.

This invention is predicated on the concept of providing an interactive system for the enjoyment of younger children which allows them to remotely control sounds produced by the shoes they are wearing. In the presently preferred embodiment, an RF transmitter, power source, reed switch and, optionally, one or more LEDs, are housed within a first wrist band worn on one arm of the child. A second wrist band worn on the other arm of the child carries a permanent magnet. When the two wrist bands are brought into proximity with one another, the magnetic field of the permanent magnet in the second wrist band causes the reed switch to close. In response, the transmitter is effective to emit an RF signal of selected frequency.

The shoe mounts an array of LEDs, one or more loudspeakers and an electrical circuit having and RF receiver. The array of LEDs is operated in the conventional manner, e.g. in a flashing or other sequence responsive to operation of an inertia switch, pressure switch, motion switch or the like mounted to the shoe. When an RF signal is produced by the first wrist band, it is sensed by the RF receiver in the shoe which, in turn, activates an integrated circuit operative to cause the loudspeaker(s) in the shoe to sound. Essentially any message or sound can be recorded and stored in the integrated circuit for play back when the integrated circuit is triggered.

The system of this invention provides an element of fun and interaction of children. He or she can control when sounds are produced by the shoe, by bringing the wrist bands together, and the LEDs or other light sources are operated by walking, running or other movement of the shoes.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
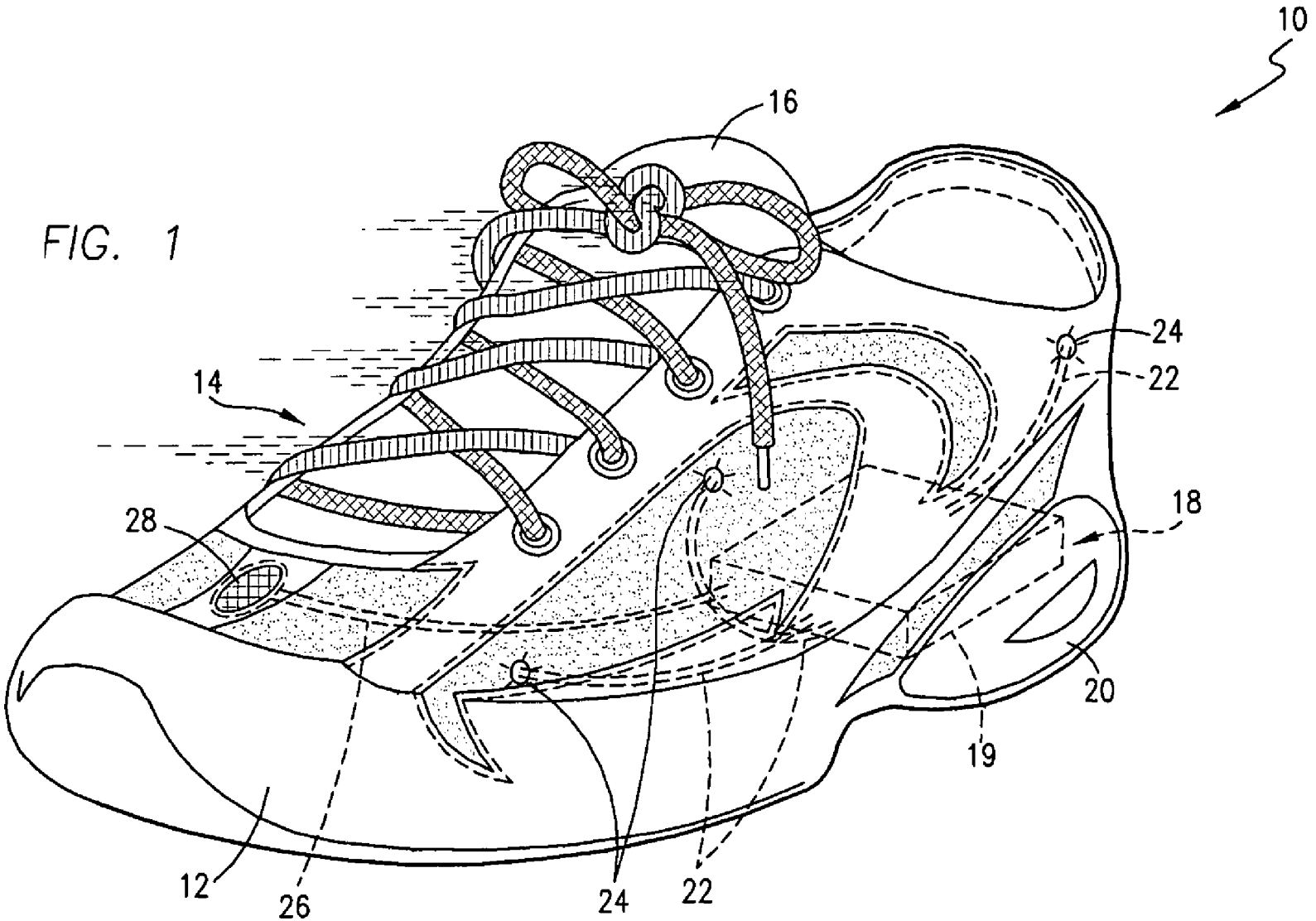
FIG. 1 is a perspective view of a shoe having an upper carrying a module which is connected to an array of LEDs and to a loudspeaker both mounted to the upper of the shoe.

Referring initially to FIG. 1, a shoe 10 is shown having an outsole 12 connected to an upper 14 including a tongue 16. It should be understood that essentially any other article of footwear is considered within the scope of this invention, and the shoe 10 is shown for purposes of illustration. As such, the term "upper" is meant to broadly encompass essentially any shoe element mounted to the outsole of an article of footwear such as the straps of a sandal, etc.

Figure 5:
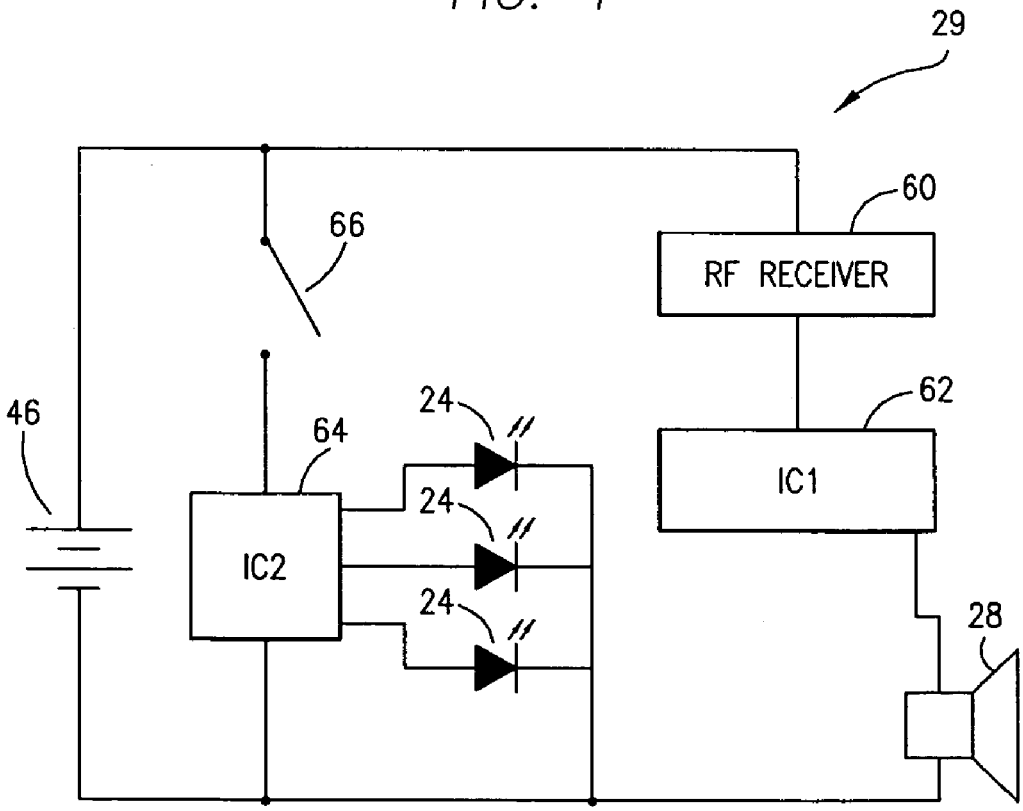
FIG. 5 is a schematic, block diagram of the electrical circuit in the shoe.

A module 18 having a housing 19 preferably made of plastic is mounted in the heel 20 of the shoe 10. A cavity (not shown) is hollowed out of the heel 20 to receive the module 18, over which the sock liner or insole of the shoe 10 is secured. As schematically illustrated in FIG. 1, the module 18 is connected by wires 22 to an array of LEDs 24 mounted to the upper 14 of the shoe 10, and by a wire 26 to a loudspeaker 28 also carried by the upper 14. As described below in connection with a discussion of FIGS. 5 and 7, the module 18 mounts an electrical circuit 29 which controls the operation of the LEDs 24 and loudspeaker 28. The particular location or arrangement of the LEDs 24 on the shoe 10 is a matter of choice, and it is contemplated they could be placed on the outsole 12, tongue 16 and in essentially any other position on the shoe 10. The loudspeaker 28 is preferably mounted to the tongue 16 or some area of the upper 14, rather than on the outsole 12.

Figure 2:
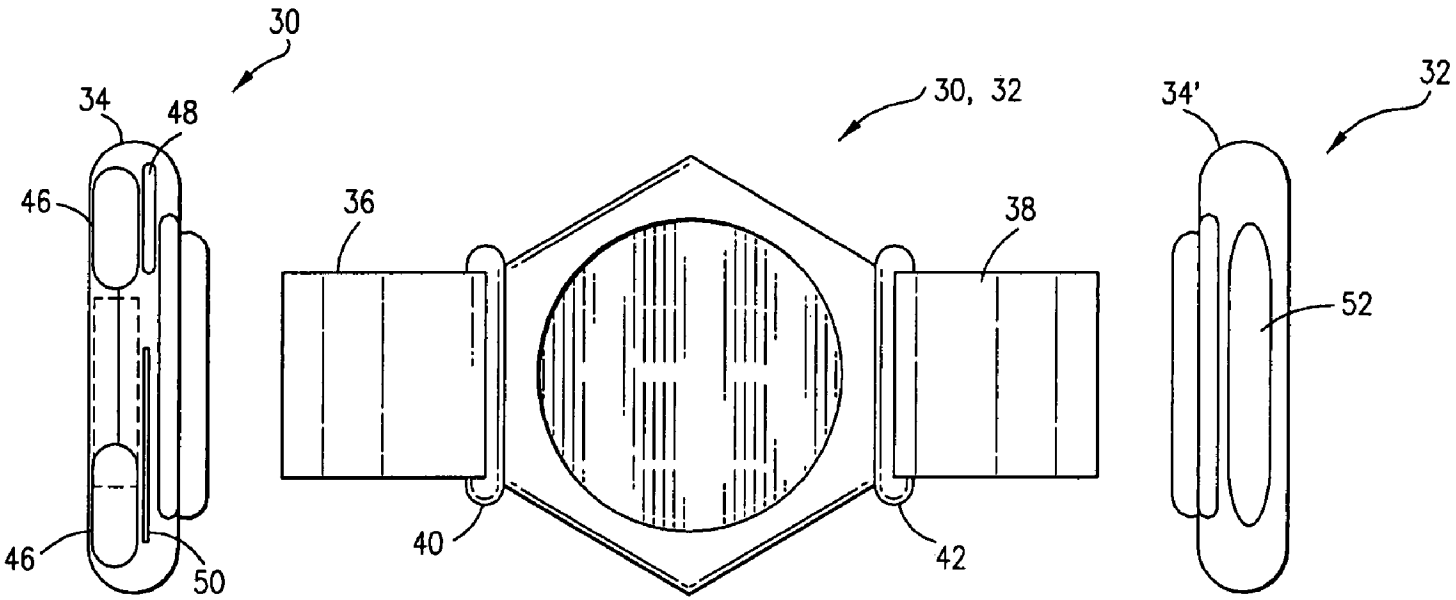
FIG. 2 is combined front view and side views of the wrist bands employed as an RF transmitting unit.
Figure 3:
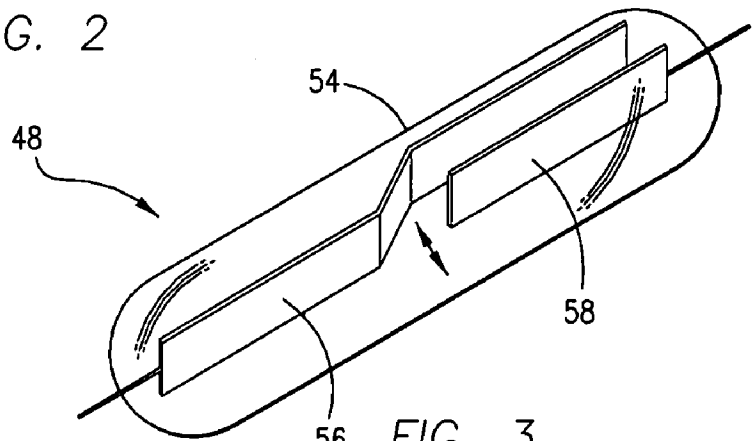
FIG. 3 is a schematic view of the reed switch carried by one of the wrist bands.
Figure 4:
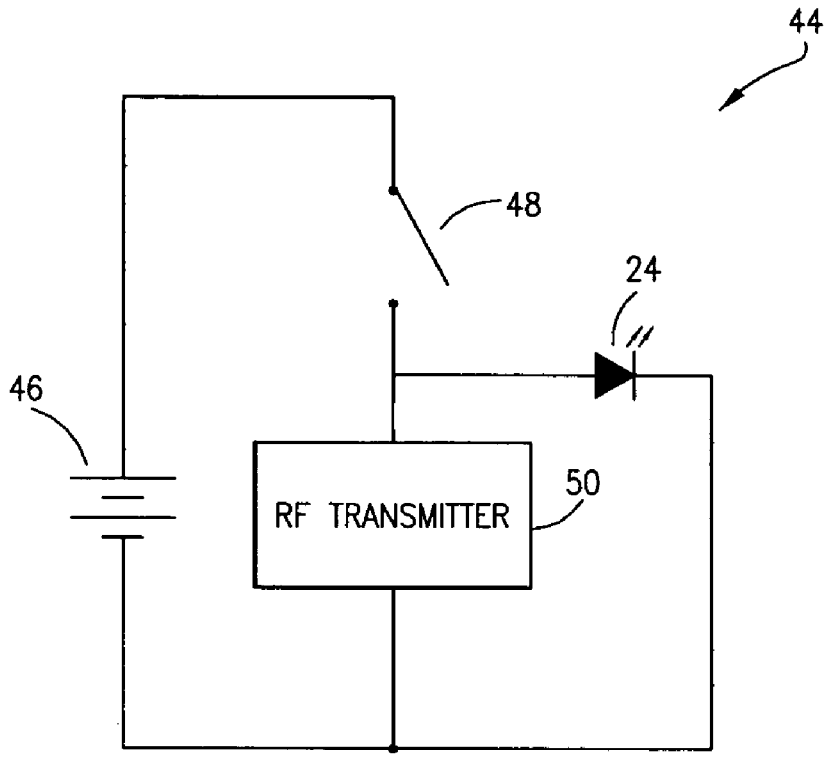
FIG. 4 is a schematic, block diagram of the electrical circuit in one of the wrist bands.

Referring now to FIGS. 2 and 3, a first wrist band 30 and a second wrist band 32 are shown. Each wrist band 30, 32 has a similar appearance when viewed from the front, as depicted in the center of FIG. 2, including a housing 34 or 34' and a pair of straps 36, 38 retained by buckles 40, 42, respectively. The housing 34 of the first wrist band 30 mounts an electrical circuit 44, schematically depicted in FIG. 4, including one or more batteries 46, a switch 48, an integrated circuit which forms part of an RF transmitter 50 described more fully below, and, optionally, one or more LEDs 24. The housing 34' of the second wrist band 32 mounts a permanent magnet 52. The switch 48 is preferably a reed switch of the type schematically shown in FIG. 3 which comprises a casing 54, a first contact 56 and a second contact 58 movable into engagement with one another.

The schematic and more detailed drawings of the electrical circuits 29 and 44 shown in FIGS. 4–7, which cooperate to activate the LEDs 24 and loudspeaker 28, illustrate one presently preferred embodiment, but it is contemplated that a variety of other circuit designs could be employed to achieve the desired result. As an overview, and with reference initially to FIGS. 4 and 5, the electrical circuit 44 contained in the housing 34 of the first wrist band 30 is operative to produce an RF signal upon closure of the reed switch 48. The reed switch 48 is influenced by the presence of a magnetic field, i.e. the first and second contacts 56, 58 move into engagement with one another when a magnetic field is applied. In order to close the reed switch 48, the permanent magnet 52 housed in the second wrist band 32 is moved into close physical proximity to the first wrist band 30 causing its magnetic field to act upon the contacts 56, 58 of the reed switch 48. As described below with reference to FIG. 6, closure of the reed switch 48 causes the RF transmitter 50 to emit an RF signal of selected wavelength.

The electrical circuit 29 housed in the module 18 of the shoe 10 generally has three parts, namely, an RF receiver 60, a sound producing portion including an integrated circuit (IC1) 62 and the loudspeaker 28, and, a light producing portion including an integrated circuit (IC2) 64 and the LEDs 24. See generally FIG. 5. As described more fully below in connection with a discussion of FIG. 7, the RF receiver 60 is operative to activate the IC 62, and, hence, the loudspeaker 28 upon receipt of a signal from the RF transmitter 50. The LEDs 24 are illuminated by the IC 64 in response to opening or closing of a switch 66 mounted to the shoe 10 or to the module 18. The switch 66 may be an inertia, motion or pressure switch which is capable of opening or closing in response to movement of the shoe 10, or in the case of a pressure switch, in response to the application of a force thereto.

Figure 6:
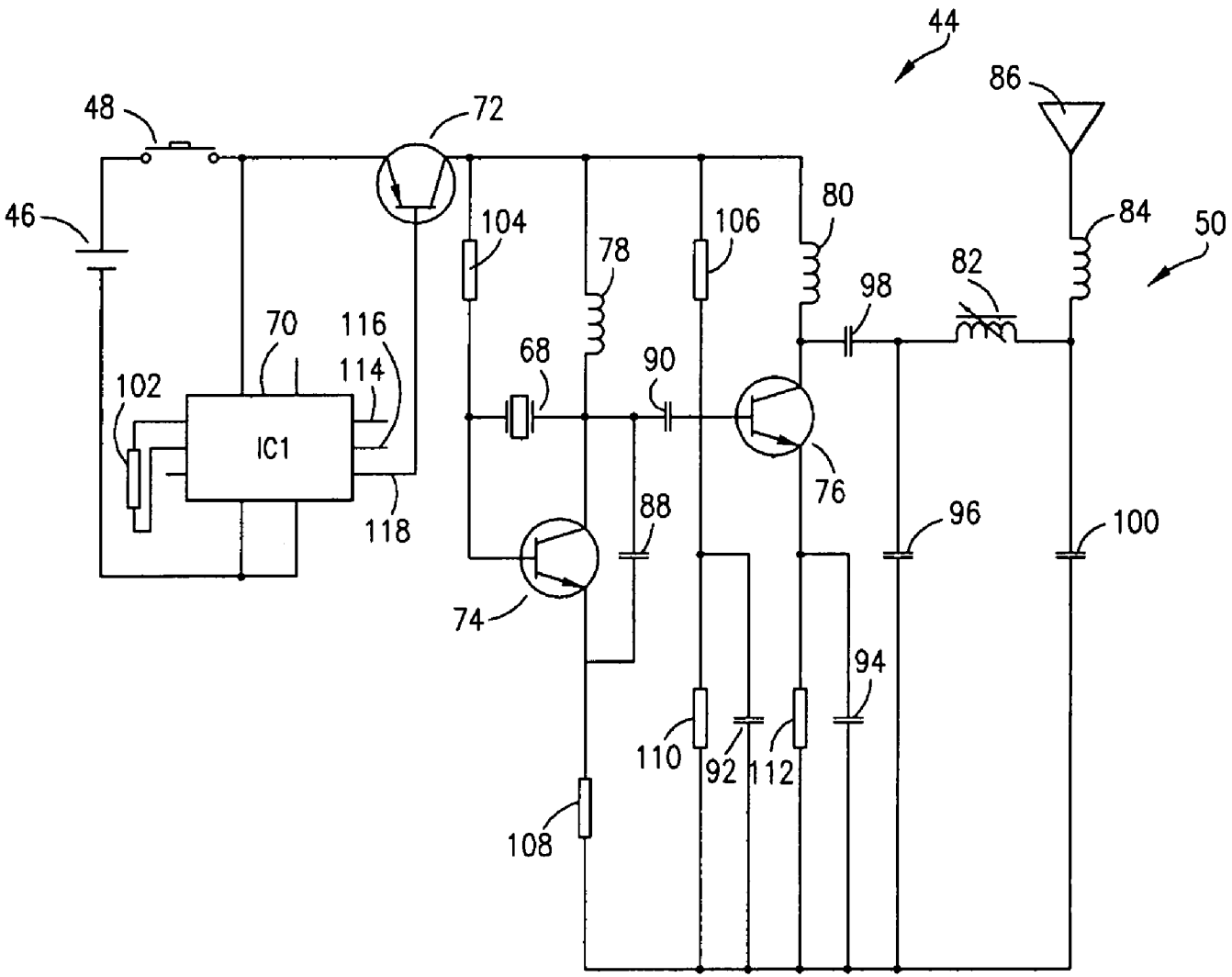
FIG. 6 is a more detailed view of the electrical circuit located in one of the wrist bands which produces an RF signal.

Referring now to FIG. 6, one presently preferred embodiment of the electrical circuit 44 is shown. It is contemplated that other circuit configurations could be employed to produce an RF signal in response to closure of a switch, and therefore this invention is not intended to be limited to the particular circuit shown. The circuit 44 generally includes a crystal 68; the reed switch 48; an IC 70; three transistors 72, 74 and 76; four inductors 78, 80, 82 and 84; an antenna 86; at least one battery 46; seven capacitors 88, 90, 92, 94, 96, 98 and 100; and, six resistors 102, 104, 106, 108, 110 and 112.

In response to closure of the reed switch 48, as described above, the IC 70 is activated and changes its LED outputs 114, 116 and 118 from high to low. Since output 118 is connected to the base of transistor 72, the IC 70 causes the transistor 72 to conduct allowing a flow of current from battery 46 to flow to the resistor 104 and inductor 78. The current passing through the resistor 104 flows to the base of transistor 74 causing it to conduct as well. The resistor 104 and inductor 78 are chosen with different resistances to create a potential across the crystal 68 causing it to generate voltage having a frequency of approximately 27.145 Hz. This voltage passes through capacitor 90 to the base of transistor 76 causing it to conduct. The voltage is amplified by transistor 76, according to its gain, and then filtered by capacitors 96, 98 and 100, and the inductor 82, so that a substantially pure frequency of 27.145 Hz is delivered to the antenna 86 for transmission to the electrical circuit 29 in the shoe 10.

Figure 7:
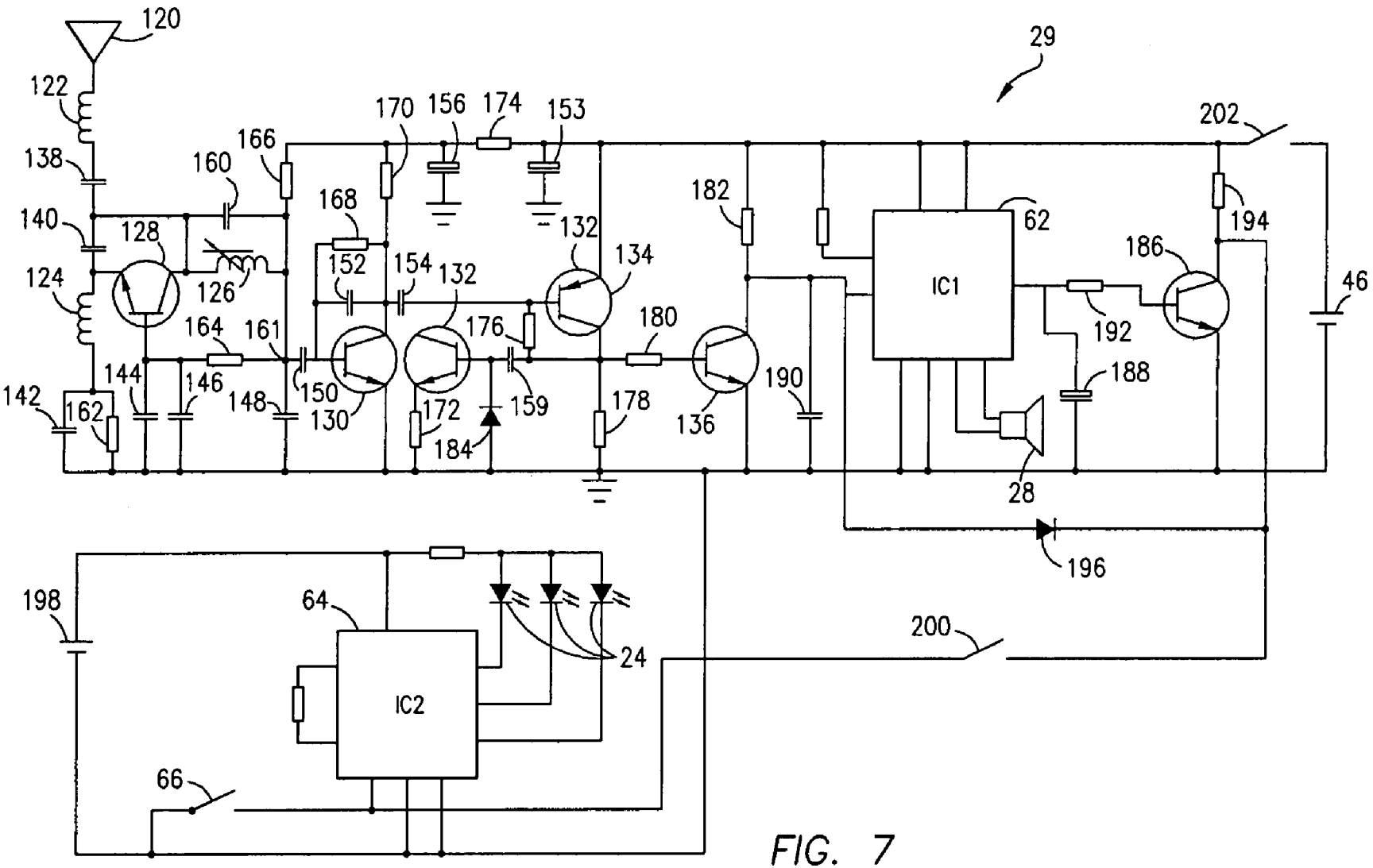
FIG. 7 is a more detailed view of the electrical circuit located in the shoe.

Referring now to FIG. 7, details of the electrical circuit 29 contained in the shoe 10 are shown. As noted above, the circuit 29 consists of three main elements, i.e. the RF receiver 60, the sound generating portion including IC 62 and the light generating portion including IC 64. The RF receiver generally includes an antenna 120; three inductors 122, 124 and 126; five transistors 128, 130, 132, 134 and 136; several capacitors 138, 140, 142, 144, 146, 148, 150, 152, 154, 156, 158, 159 and 160; several resistors 162, 164, 166, 168, 170, 172, 174, 176, 178, 180 and 182; and a diode 184. The sound generating portion of the circuit 29 generally includes the sound IC 62; loudspeaker 28; a transistor 186; two capacitors 188, 190; resistors 192, 194; and, a diode 196. The light producing portion of the circuit 29 generally includes the light IC 64, the inertia, motion or pressure switch 66, LEDs 24 and a battery 198.

The light producing portion of the circuit 29 operates in a known manner. In response to movement of the shoe 10, such as by walking or running, the motion, inertia or pressure switch 66 operates to activate light IC 64 which, in turn, illuminates the LEDs 24 in a selected flashing pattern, or essentially any other type of lighting sequence.

The sound producing portion of the circuit 29 is dependent on the production of an RF signal from the transmitter 50 associated with first wrist band 30, the receipt of such signal by the receiver portion of circuit 29 and resulting production of a trigger signal input to the sound IC 62. Initially, when switches 200 and 202 close, provided antenna 120 does not receive a 27.145 Hz radio frequency signal, transistor 136 continues conducting and its collector, which is connected to the trigger terminal of integrated circuit 62, remains at a low potential thereby keeping integrated circuit 62 deactivated so that speaker 28 does not sound. When antenna 120 receives a radio frequency signal from transmitter 50, inductor 122 and capacitor 138 resonate at a high frequency voltage which induces a high frequency voltage causing a high frequency current to flow through inductor 124 and the network formed by capacitor 142 and resistor 162. As a result, the base voltage of transistor 128 transitions from low to high, causing transistor 128 to conduct. Conduction of transistor 128 causes inductor 126 and capacitor 160 to resonate at their resonant frequency, thereby causing the node 161 between resistor 164 and capacitor 150 to alternatively transition from a high potential to a low potential and vice versa.

When node 161 is at a low potential, transistor 130 does not conduct. When transistor 130 is not conducting, its collector is at a high potential which keeps transistor 132 conducting. This holds the base of transistor 134 at a high potential which prevents transistor 134 from conducting. When transistor 134 does not conduct, its collector remains at a low potential thereby stopping transistor 136 from conducting. When transistor 136 stops conducting, its collector voltage changes from low to high, thereby triggering integrated circuit 62 causing speaker 28 to sound.

Conversely, when the potential at node 161 is high, transistor 130 conducts due to the high potential at its base. Conduction of transistor 130 pulls the collector of transistor 132 low, thereby causing transistor 132 to stop conducting. Conduction of transistor 46 in turn pulls the base of transistor 134 low, causing transistor 134 to conduct. Conduction of transistor 134 makes the voltage at the collector of transistor 134 and the base of transistor 136 assume a high voltage which causes transistor 136 to conduct. Conduction of transistor 136 pulls its collector low which prevents integrated circuit 62 from triggering.

The particular sound produced by the speaker 28 in response to the signal from IC 62 is a matter of choice, and is intended to add to the enjoyment of the interactive wrist band-shoe combination of this invention. As noted above, instead of causing a speaker in the shoe of the wearer to sound in response to the "automatic" activation of a switch in the shoe, e.g., inertia, motion, pressure, etc.) or a manually activated switch, the present invention provides for remote activation of the speaker via RF signals transmitted from the wrist band 30.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, the RF transmitter portion of the system of this invention is shown housed in a wrist band intended to be worn on the arm of the user which is actuated by a reed switch moved to the closed position when placed in proximity to a permanent magnet carried by a second wrist band worn on the other arm of the user. It should be understood that the RF transmitter could be incorporated into essentially any other article of clothing, or other objects separate from the shoes of the wearer, such as a back pack, lunch box, toy or the like. Further, the permanent magnet may be carried by a complimentary article of clothing or any other object so long as it is movable with respect to the article of clothing or object which houses the RF transmitter so as to activate the reed switch or other magnetically sensitive switch.

Therefore, it is intended that the invention not be limited to the particular embodiment disclosed as the best mode contemplated for carrying out this invention, but that the invention will include all embodiments falling within the scope of the appended claims.

I claim:

1. A system for producing a light and sound, comprising:

a first wrist band having a first electrical circuit including a first switch operative in response to the presence of a magnetic field and a transmitter coupled to said first switch, said transmitter being effective to emit an RF signal in response to operation of said first switch;

a second wrist band which mounts a permanent magnet, said second wrist band being movable into sufficient proximity to said first wrist band so that the magnetic field of said permanent magnet causes said first switch to move to a closed position;

an article of footwear;

a second electrical circuit mounted to said article of footwear, including:

(i) at least one light source;

(ii) a first integrated circuit coupled to said at least one light source;

(iii) a second switch coupled to said first integrated circuit, said second switch being operative as a result of motion of said article of footwear, said first integrated circuit being effective to illuminate said at least one light source in response to operation of said second switch;

(iv) a loudspeaker;

(v) a second integrated circuit coupled to said loudspeaker;

(vi) a receiver operative to receive said RF signal from said transmitter and then cause said second integrated circuit to sound said loudspeaker.

2. The system of claim 1 in which said first switch is a reed switch capable of moving to a closed position in response to exposure to said magnetic field.

3. The system of claim 2 in which said movement of said reed switch to said closed position causes said transmitter to emit an RF signal.

4. The system of claim 1 in which said second switch is an inertia switch.

5. The system of claim 1 in which said first and second wrist bands are intended to be worn by a user.

6. A system for producing light and sound, comprising:

a first unit having a first electrical circuit including a first switch operative in response to the presence of a magnetic field and a transmitter coupled to said first switch, said transmitter being effective to emit an RF signal in response to operation of said first a second unit which mounts a permanent magnet, said second unit being movable into sufficient proximity to said first unit so that said magnetic field of said permanent magnet causes said first switch to move to a closed position;

a transmitter coupled to said first switch, said transmitter being effective to emit an RF signal in response to movement of said first switch to the closed position;

an article of footwear;

a second electrical circuit mounted to said article of footwear, including:

(i) at least one light source;

(ii) a first integrated circuit to said at least one light source;

(iii) a second switch coupled to said first integrated circuit, said second switch being operative as a result of movement of said article of footwear, said first integrated circuit being effective to illuminate said at least one light source in response to operation of said second switch;

(iv) a loudspeaker;

(v) a second integrated circuit coupled to said loudspeaker;

(vi) a receiver operative to receive said RF signal from said transmitter and then cause said second integrated circuit to sound said loudspeaker.

7. The system of claim 6 in which said first switch is a reed switch.

8. The system of claim 6 in which said second switch is an inertia switch.

9. The system of claim 6 in which at least one of said first and second units is adapted to be worn by a user.

* * * * *